United States Patent [19]

Moriarty

[11] 4,347,799

[45] Sep. 7, 1982

[54] SAIL CATCHER

[76] Inventor: Vincent C. Moriarty, 3474 Sunset La., Oxnard, Calif. 93030

[21] Appl. No.: 72,354

[22] Filed: Sep. 4, 1979

[51] Int. Cl.[3] ..... B63H 9/04

[52] U.S. Cl. ..... 114/102; 114/105; 114/108; 248/206 A

[58] Field of Search ..... 114/39, 89, 90, 92–98, 114/102, 104, 105, 108, 111; 248/206 A

[56] References Cited

U.S. PATENT DOCUMENTS

| | | | |
|---|---|---|---|
| 173,427 | 2/1876 | Stillman | 114/102 |
| 359,028 | 3/1887 | O'Brien | 114/102 |
| 639,916 | 12/1899 | Achterberg | 114/105 |
| 879,986 | 2/1908 | Tatchell | 114/89 |
| 4,211,382 | 7/1980 | Bonfils | 248/206 A |
| 4,280,431 | 7/1981 | Sofen | 114/105 |

*Primary Examiner*—Charles E. Frankfort

*Attorney, Agent, or Firm*—Freilich, Hornbaker, Wasserman, Rosen & Fernandez

[57] ABSTRACT

Apparatus useful in combination with a sailboat boom for forming a basket-like structure positioned to catch a sail as it is being lowered. More particularly, the sail catching apparatus disclosed comprises two arm pairs pivotally mounted to the boom, the arms of each arm pair being on opposite sides of the boom. The arms on each side of the boom are interconnected by the flexible line segments and pivot outwardly from the boom to a predetermined angle. The end of each arm closest to the outer end of the boom is connected to a securing line which, when tension is applied thereto, causes each arm to pivot outwardly to the predetermined angle defined by a stop, this arm then drawing the other arm out to its associated stop. The securing lines are then tied to cleats provided on the boom. The outwardly extending arms and their associated line segments form a basket for catching a sail as it is lowered.

9 Claims, 8 Drawing Figures

SAIL CATCHER

BACKGROUND OF THE INVENTION

The invention relates to devices for catching and supporting a sailboat sail as it is lowered.

Popularity of sailing has increased many fold over the last few decades. Frequently, it is necessary to lower the sails during periods of excessive wind or when approaching a docking area. One problem with lowering a sail is that it drapes over the boom holding the lower portion of the sail and rests on the bottom of the sailboat or on top of the cabin. The result is the sail obstructs the vision of a helmsman, becomes dirty dragging in the bottom of the boat or the cabin top, and makes it difficult to pivot the boom around the mast because of the dragging sail. The present invention is directed towards eliminating these problems by providing a means useful with a sailboat boom for catching a sail as it is being lowered.

SUMMARY OF THE INVENTION

More particularly, the present invention is directed to apparatus useful in combination with a sailboat boom for forming a basket-like structure positioned to catch a sail as it is being lowered.

In accordance with a significant feature of the invention, the boom supports arms which are movable between a retracted position and an extended position. In the retracted position, the arms are out of the way and do not interfere with the normal functioning of the boom. In the extended position, the arms move outwardly from the boom to form a basket-like structure useful for catching a sail as it is being lowered.

The preferred sail catching apparatus disclosed herein comprises a plurality of arms pivotally mounted along each side of a sailboat boom. Each arm has an associated stop means which defines a predetermined angle beyond which the arm cannot pivot. The arms along each side of the boom are interconnected by a plurality of line segments so that when the aft or rearmost arm is pivoted outwardly to its respective stop means, the other arms on that same side also will be pivoted outwardly to their respective stop means by tension on the line segments. The arms when pivoted outwardly define, in conjunction with the line segments, a basket for containing the sail when it is lowered.

DETAILED DESCRIPTION

A detailed illustrative embodiment of the invention disclosed herein exemplifies the invention and is currently considered to be the best embodiment for such purposes. However, it is to be recognized that other means for mounting and extending the sail catcher arms could be utilized. Accordingly, the specific embodiment disclosed is only representative in providing a basis for the claims which define the scope of the present invention.

As previously explained, the invention provides a plurality of pivotally mounted arms on each side of a sail boom. All arms on one side of the boom are interconnected by a plurality of line segments so that when an aft arm is pivoted outwardly from the boom, the remaining arms on that side of the boom will be pulled outwardly also. Two securing lines are formed by an extension of one of the line segments and are used to extend the arms and hold them in place. Stop means are provided for each arm so that it can pivot to a predetermined angle, this angle generally being 90° with respect to the boom. A means is provided so that the end of the securing line can be tied to the boom, thereby holding the arms in an extended configuration. In accordance with another feature of the invention, the arms are attached to the boom in a way so that when in a fully extended position, they angle upwardly with respect to the horizontal in order to catch the sail as it is lowered. A magnet is provided at the non-pivoted or outer end of each arm, the magnet being in a magnetically coupled relationship to a corresponding magnet mounted on the boom when the arm is pivoted inwardly against the boom so that the arms are held flush against the boom when not in use.

Figure 1:
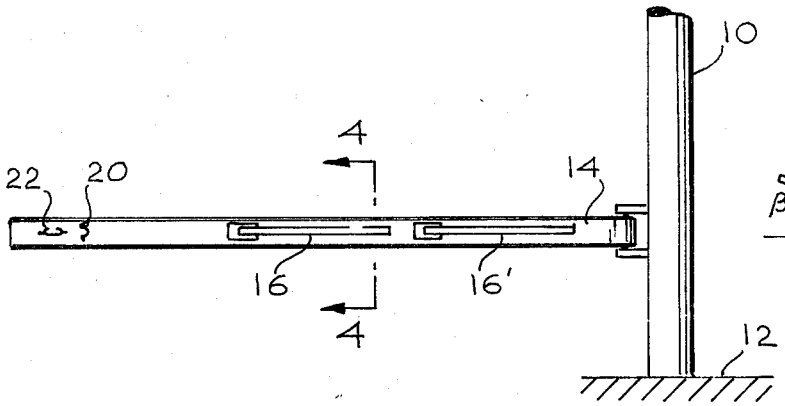
FIG. 1 is a side elevation view of the sail catcher provided by the invention.
Figure 2:
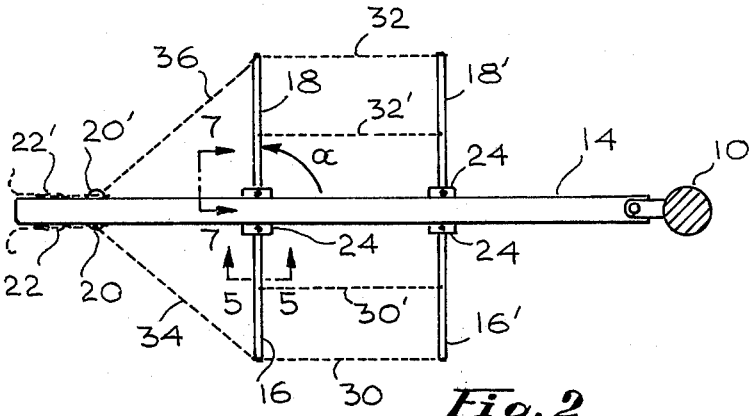
FIG. 2 is a plan view showing the arms of the sail catcher in a fully extended position.

Referring now to FIGS. 1 and 2, a sailboat mast 10 is mounted to the floor 12 of a sailboat and has rotatably mounted boom 14 from which a sail (not shown) is to be attached. Two arms are mounted on each side of the boom, the ones on the right side being designated as first arms 16 and 16', the ones on the left side of the boom being designated as second arms 18 and 18'. On each side of the boom 14 and at its end, small strap loops 20 and 20' and cleats 22 and 22' are provided. Referring to FIG. 2, the first arms 16 and 16' and the second arms 18 and 18' are shown in a fully extended position, the aftermost arms 16 and 18 defining a first arm pair, and the forward arms 16' and 18' defining a second arm pair. The aftermost arm is defined as the arm whose end rotates away from all the other arm ends when it pivots outwardly. Thus, if the arms were pivoted at the opposite ends than shown in FIG. 1, then the aftermost arms would be those closest to the mast. Although the arms of each arm pair are shown directly opposite each other, it is not necessary that the arms be spaced opposite each other, nor is it necessary that there be the same number of arms on each side of the boom 14.

Each arm is pivotally mounted to a hinge pin holder 24 to be described below. A stop means is also incorporated so that the arms can pivot outwardly to a predetermined angle, alpha. Although in the particular embodiment shown, alpha is assumed to be the same for each of the arms; it is not necessary that the predetermined angle be the same for all arms. Two lines segments 30 and 30' formed of a flexible material are used to interconnect the first arms 16 and 16', their lengths being chosen so that when the aftermost arm 16 is pivoted outwardly to the predetermined angle alpha, the forward arm 16' will also be pivoted outwardly to its associated stop means. Similarly, two other line segments 32 and 32' are attached to the second arms 18 and 18', and are chosen so that when the aftermost arm 18 is pivoted outwardly to the predetermined angle alpha, the forward arm 18' will also be pivoted outwardly to its associated stop means. A first securing line 34, which could be an extension of the line segments 32, is provided at the end of the first aftermost arm 16 and a second securing line 36 is provided at the end of the second aftermost arm 18.

In operation, each securing line 34 and 36 is fed through its associated strap loop 20 or 20'. Tension on the two securing lines 34 and 36 will cause each of the two aftermost arms 16 and 18 to pivot outwardly from the boom 14 until stopped by its associated stop means, thereby defining the predetermined angle alpha with respect to the boom 14. As the aftermost arms 16 and 18 pivot outwardly, tension created on their respective line segments 30 and 30', and 32 and 32', respectively, also cause the forward arms 16' and 18' to pivot outwardly to their respective stop means. After all arms are restrained by their respective stop means, the securing lines 34 and 36 can be secured to their respective cleats 22 and 22', thereby maintaining the arms in an outwardly extended configuration. Thus, as the operator lowers the sail, these outwardly extending arms, securing lines, and line segments will catch the sail and prevent it from falling to the floor 12 of the sailboat.

Figure 3:
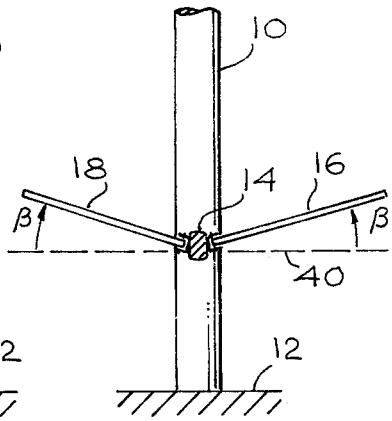
FIG. 3 is a front view showing an upper tilt to the arms.
Figure 4:
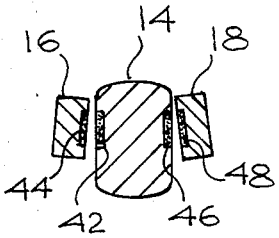
FIG. 4 is a cross-sectional view taken along line 4—4 of FIG. 1.

Referring to FIG. 3, the aftermost arms 16 and 18 are angled upwardly at an angle beta with respect to the horizontal as indicated by the dotted line shown at 40, thereby forming a triangular basket for containing the sail. When the arms are extended inwardly to the boom 14, a holding means for the arms is provided. Referring to FIG. 4, a first magnet pair consisting of a boom magnet 42 and an arm magnet 44 are provided for the first aftermost arm 16. The boom magnet 42 is attached to the boom 14 and the arm magnet 44 is attached to the arm 16. The two magnets 42 and 44 are positioned so that they will be in a magnetically coupled relationship to each other when the arm 16 is in a fully retracted position. Similarly, a second magnet pair consisting of a boom magnet 46 and an arm magnet 48 are provided for the second arm 18. Each of the other arms has a similar magnet pair associated therewith so that when they are pivoted inwardly against the boom 14, they will be held in that position until tension is applied to their respective securing lines 34 and 36.

Figure 5:
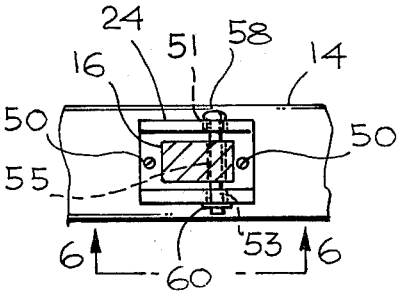
FIG. 5 is a side view showing mounting of the hinge pin holder to the boom.
Figure 7:
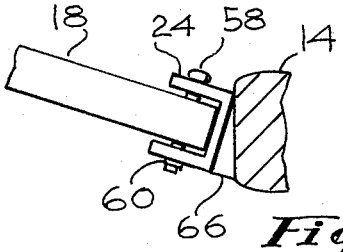
FIG. 7 is a cross-sectional view taken along line 7—7 of FIG. 2 showing a tapered shim for providing an upward tilt to the sail catcher arm.
Figure 8:
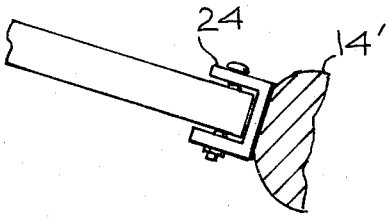
FIG. 8 is a cross-sectional view showing mounting of the hinge pin holder to an elliptically-shaped boom.
Figure 6:
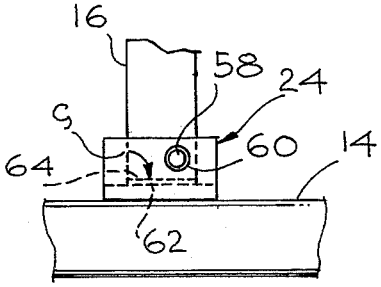
FIG. 6 is a plan view showing mounting of the hinge pin holder to the boom.

Referring to FIGS. 5 and 6, the hinge pin holder 24 is shown, the holder 24 being a U-shaped channel mounted by mounting screws 50 to the boom 14 so that the open side faces outwardly. Holes 51 and 53 are formed by the sides of the holder 24. A hole 55 is also formed in the first aftermost arm 16, the hole 55 being offset in the direction of the mast 10. A hinge pin 58 is provided for insertion through the holder holes 51 and 53 and the arm hole 55. A securing ring 60 is provided for preventing the hinge pin 58 from slipping out, the ring 60 being adapted to slide into a hole (not shown) formed in the end of the hinge pin 58. The angle sigma formed between the end of the arm 62 and the side of the arm 64 determines the angle alpha beyond which the arm 16 cannot rotate. Thus, in this embodiment the stop means is provided by the end of the arm 62 abutting against the bottom of the hinge pin holder 24 as it is pivoted outwardly from the boom 14.

It should now be apparent from the above description that a sail catcher has been described which comprises a plurality of arms which can be pivoted outwardly and secured in an extended position, thereby providing a receptacle for a sail to be lowered. Although the invention has been described in terms of two arm pairs, any number of arm pairs could be utilized, each arm being connected to an adjacent arm by line segments as described for the first two arm pairs. Although magnets have been shown for securing the arms to the boom when in a retracted position, other kinds of securing means could be incorporated such as a line tied around the two arms or an interlocking material such as Velcro being attached to both the arms and the boom, or one of many types of latch mechanisms.

What is claimed is:

1. An extendable sail catcher to be mounted on a boom of a sailboat, comprising:

a pair of arms, each of which is positioned on opposite sides of said boom;

hinge means attached to one end of each of said arms and to said boom;

means for pivoting each of said arms outwardly from said boom about said hinge means until each arm defines a predetermined angle with respect to said boom, said means for pivoting comprising first and second securing lines each attached to one of said arms so that said arms will pivot to said predetermined angle when tension is applied to said lines;

stop means for preventing each of said arms from pivoting beyond said predetermined angle;

means for securing said first and second securing lines to said boom whereby said arms will be held against said stop means at said predetermined angle so that said pair of arms and said first and second securing lines define a basket-like structure for catching a sail when it is lowered to said boom; and means for holding said arms against said boom when they are pivoted inwardly with respect to said boom comprising first and second magnet pairs, said first magnet pair having one magnet thereof attached to said first arm and the other magnet thereof attached to said boom, said second magnet pair having one magnet thereof attached to said second arm and the other magnet thereof attached to said boom whereby when said arms are pivoted inwardly to said boom, said first pair of magnets are magnetically coupled to each other and said second pair of magnets are magnetically coupled to each other.

2. An extendable sail catcher to be mounted on a boom of a sailboat, comprising:

a pair of arms each of which is positioned on opposite sides of said boom;

hinge means attached to one end of each of said arms and to said boom;

means for pivoting each of said arms outwardly from said boom about said hinge means until each arm defines a predetermined angle with respect to said boom;

stop means for preventing each of said arms from pivoting beyond said predetermined angle;

one or more additional pairs of arms positioned longitudinally along said boom, each arm of each pair being positioned on opposite sides of said boom; and wherein said means for pivoting comprises first and second line segments respectively interconnecting said arms on opposite sides of said boom and adapted so that when an aftermost arm on each side of said boom is extended to said predetermined angle all of said arms on that side will be extended to said predetermined angle by tension on said respective first and second line segments;

first and second securing lines each attached to an aftermost arm on each side of said boom so that all of said arms will pivot to said predetermined angle when tension is applied to said first and second securing lines; and means for securing said first and second securing lines to said boom whereby said arms will be held by said stop means at said predetermined angle so that said arms and said line segments define a basket-like structure for catching a sail when it is lowered to said boom.

3. A sail catcher to be mounted on a sail boat boom having an inner end mounted to a mast, comprising:

two or more first arms longitudinally positioned along one side of said boom;

two or more second arms longitudinally positioned along the other side of said boom;

a plurality of pivot means attached to end portions of each of said arms and to said boom;

means for pivoting each of said arms outwardly from said boom to a predetermined angle with respect to said boom;

said means for pivoting comprising a first plurality of line segments interconnecting said first arms so that when one of said first arms is pivoted outwardly from said boom, tension on said first plurality of line segments will cause the other of said first arms to pivot outwardly;

a second plurality of line segments interconnecting said second arms so that when one of said second arms is pivoted outwardly from said boom, tension on said second plurality of line segments will cause the other of said second arms to pivot outwardly;

first and second securing lines respectively attached to one of said first and second arms so that said arms will pivot to said predetermined angle with respect to said boom when tension is applied to said securing lines; and means for securing said first and second securing lines to said boom whereby said arms will be held at said predetermined angel so that said first arms and said second arms and said first and second pluralities of line segments define a basket-like structure for catching a sail when it is lowered to said boom.

4. The sail catcher of claim 3 further comprising magnetic coupling means for holding said arms against said boom when in an inwardly pivoted configuration.

5. Apparatus useful in combination with a sailboat boom for catching a sail as it is being lowered, said apparatus comprising:

a first arm hinged to a first side of said boom and pivotable between a retracted position extending substantially parallel to said boom and an operative position extending substantially perpendicularly from said boom;

a second arm hinged to said first side of said boom spaced therealong from said first arm and pivotable between a retracted position extending substantially parallel to said boom and an operative position extending substantially perpendicularly from said boom and substantially parallel to the operative position of said first arm;

at least one flexible line segment extending between said first and second arms for forming a basket-like structure when said arms are in said operative position for catching a sail when it is lowered to said boom; and means for selectively securing said first and second arms in either said operative or retracted position.

6. The apparatus of claim 5 including a third arm hinged to a second side of said boom and pivotable between a retracted position extending substantially parallel to said boom and an operative position extending substantially perpendicularly from said boom in a direction opposite to the operative position of said first arm;

a fourth arm hinged to said second side of said boom spaced therealong from said third arm and pivotable between a retracted position extending substantially parallel to said boom and an operative position extending substantially perpendicularly from said boom and substantially parallel to the operative position of said third arm;

at least one flexible line segment extending between said third and fourth arms for forming a basket-like structure when said arms are in said operative position for catching a sail when it is lowered to said boom; and means for selectively securing said third and fourth arms in either said operative or retracted position.

7. The apparatus of claim 5 including stop means for preventing each of said arms from pivoting beyond a predetermined angle.

8. The apparatus of claim 5 further comprising means for causing each of said first and second arms to be angled upwardly from said boom with respect to the horizontal when said arms are pivoted to said operative position.

9. A sail catcher to be mounted in a sailboat boom having an inner end mounted to a mast, comprising:

two or more first arms hinged to said boom along a first side thereof and spaced therealong;

two or more second arms hinged to said boom along a second side thereof and spaced therealong;

means for selectively pivoting said arms outwardly from a retracted position substantially parallel to said boom to an operative position substantially perpendicular to said boom;

means for securing said means in either said retracted or operative position;

at least one flexible line segment extending between said first arms for forming a basket-like structure therewith when said first arms are in said operative position to catch a sail when it is lowered to said boom; and at least one flexible line segment extending between said second arms for forming a basket-like structure therewith when said second arms are in said operative position to catch a sail when it is lowered to said boom.

* * * * *